United States Patent [19]

Kamarian et al.

[11] 4,136,004

[45] Jan. 23, 1979

[54] SOLID ELECTRODE ELECTROLYZER FOR ELECTROLYSIS OF AQUEOUS SOLUTIONS

[76] Inventors: Georgy M. Kamarian, Kotelnicheskaya naberezhnaya, 25/8, kv. 45; Leonid A. Kostandov, Vorobievskoe shosse, 6, kv. 4; Vladimir M. Zimin, 10 proezd Mariinoi roschi, 13, kv. 251, all of Moscow, U.S.S.R.

[21] Appl. No.: 703,922

[22] Filed: Jul. 9, 1976

[30] Foreign Application Priority Data

Jul. 15, 1975 [SU] U.S.S.R. ..... 2155302

[51] Int. Cl.[2] ..... C25B 1/16; C25B 1/26; C25B 9/00

[52] U.S. Cl. ..... 204/256; 204/252; 204/266; 204/275

[58] Field of Search ..... 204/252, 253, 254, 256, 204/278, 268, 95, 98, 270, 275

[56] References Cited

U.S. PATENT DOCUMENTS

| | | | |
|---|---|---|---|
| 1,263,314 | 4/1918 | Emanuel | 204/278 |
| 3,766,044 | 10/1973 | Westerlund | 204/268 |
| 3,809,629 | 5/1974 | Messner et al. | 204/95 |
| 3,813,326 | 5/1974 | Gunby | 204/254 X |
| 3,898,149 | 8/1975 | Kircher et al. | 204/252 |
| 3,923,630 | 12/1975 | Argade et al. | 204/266 |
| 3,972,795 | 8/1976 | Goens et al. | 204/270 X |

*Primary Examiner*—Arthur C. Prescott
*Attorney, Agent, or Firm*—Lackenbach, Lilling & Siegel

[57] ABSTRACT

An electrolyzer for electrolysis of aqueous solutions of alkali metal chlorides, comprising a horizontal casing filled with an electrolyte and two end monopolar electrodes placed therein. The casing of the electrolyzer is a cylinder made from a corrosion-resistant nonconducting material, its bases being secured to the bases of the monopolar electrodes, thus forming a tight cylindrical chamber.

18 Claims, 18 Drawing Figures

SOLID ELECTRODE ELECTROLYZER FOR ELECTROLYSIS OF AQUEOUS SOLUTIONS

The invention relates to devices for producing inorganic compounds by electrolysis and, in particular, to solid electrode electrolyzers for electrolyzing of aqueous solutions of chlorides of alkali elements.

The disclosed electrolyzer is employed for simultaneous production of alkali metal hydroxides and chlorine or salts of its oxyacids. Due to an increased demand in chlorine and growing capacity of chlorine production, the industry makes use of large-capacity electrolyzer units containing large diameter pipe lines.

Chlorine is stored and transported as a liquid. Expensive gas blowers, compressors, and refrigeration apparatus are required for conversion of chlorine into the liquid state.

The existing process of liquid chlorine production is complicated, labour-consuming and expensive.

The process of liquid chlorine production is drastically simplifed when chlorine is produced under high pressure in electrolyzers.

There are no electrolyzers for production of chlorine under pressure at present.

The disclosed invention offers a solution to this problem.

There are known electrolyzers for electrolysis of solutions under pressure, eg. Zdansky-Lonz electrolyzers for water electrolysis under pressure (cf. L. M. Yakimenko and others "Electrolysis of water", "Khimia" publishers, Moscow, 1970, pp. 180–186).

The water electrolyzer comprises bipolar electrodes having a round current-distributing base with anode and cathode members attached thereto and two monopolar electrodes.

Electrodes and annular insulating gaskets placed therebetween are tightened into a single unit similar to a filter press by means of end plates and anchor bolts. The electrolyzer is provided with inner channels for collection of hydrogen and oxygen and distribution of the circulating electrolyte and the supply water.

Inner ducts are formed by matching the openings made in the base of the bipolar electrodes and gaskets alternating therewith.

In order to prevent mixing of the electrolysis products forming on the anode and cathode members, an asbestos membrane is placed between said members.

Owing to its constructional features the electrolyzer for water electrolysis cannot be employed for electrolysis of solutions to obtain chlorine and sodium hydroxide. In particular, the electrolyzer features a plurality of junctions between electrodes, which require special sealing, because even an insignificant amount of liberated chlorine is hazardous to the operating personnel and causes corrosion of the electrolyzer and associated equipment.

Sealing gaskets located between the electrodes are subjected, apart from the high pressure, to a strong corroding action of chlorine and, consequently, quickly wear out.

The maximum electrical load on an electrode in such an electrolyzer is insignificant, somewhere about 4-kA, and the output of the electrolyzer is on the whole not large. In order to increase the output capacity of the electrolyzer, a large number of electrodes are to be used, which makes the number of junctions still greater and, consequently, the design of the electrolyzer becomes much more complicated owing to the requirements of reliable sealing.

The water electrolyzer provides no features for electrolysis of solutions to produce chlorine and sodium hydroxide. In particular, there is insufficient volume for the required amount of the electrolyte and no level control to set optimum permeability of the membrane in order to obtain the needed concentration of the sodium hydroxide solution.

There is also no separation space for separating of the produced chlorine from the electrolyte.

Such an electrolyzer is also difficult to assemble and disassemble because of the large number of components.

There is also known an electrolyzer for electrolysis of aqueous solutions of chlorides of alkali metals to produce chlorine and alkali (cf. Japanese Pat. No. 5,. Cl.15F, 1951).

The known electrolyzer comprises a horizontally placed rectangular housing made from a nonconducting material filled with the electrolyte and two end monopolar electrodes.

One of these electrodes, the anode, is provided with a base featuring feeding busbars connected to the base and anode members attached to the inner side of the base and immersed into the electrolyte.

Another electrode, the cathode, is provided with feeding busbars connected to the base and cathode members immersed in the electrolyte and attached to the base from the inside so that a common cathode space is formed between the cathode members and the base.

Located between monopolar electrodes are bipolar electrodes, each having a current distributing base, the anode members being attached from one side of said base and the cathode members being attached from the other side of said base. The cathode members are attached to the base so that a common cathode space is formed between the cathode members and the base.

The bipolar and monopolar electrodes are enclosed into a housing. The electrolyzer is covered from the top by a lid made of a nonconducting and chemically resistant material.

The electrolyzer also comprises an electrolyte supply device which consists of a number of connecting pipes located on the lid of the electrolyzer, a chlorine tapping device made as a connecting pipe on the lid of the electrolyzer, an alkali and hydrogen tapping devices which are connecting pipes located on the electrolyzer housing, each connecting pipe being coupled to the common cathode space of one of the electrodes.

The known electrolyzer cannot be used for producing chlorine under pressure, because for this purpose a complete sealing of the whole electrolyzer must to be ensured. The housing of the known electrolyzer is covered by a lid and it becomes necessary to ensure complete sealing of the lid-to-housing junction.

But because of the large size of the lid and the housing, practical sealing is difficult.

With the increase of the electrolyzer output capacity, these difficulties accumulate as the perimeter to be sealed grows.

It is an object of this invention to provide a large capacity electrolyzer ensuring electrolysis under pressure of aqueous solutions of chlorides of alkali metals to produce hydroxides of alkali metals and chlorine or salts of its oxyacids.

This object is achieved by means of an electrolyzer with solid electrodes for electrolysis of aqueous solutions of alkali metal chlorides, comprising a horizontal casing filled with an electrolyte, two end monopolar electrodes, one of said electrodes, an anode, having a base provided with feeding busbars connected to the outer side of the base and anode members secured on the inner side of the base and immersed in the electrolyte, whereas the other of said electrodes, a cathode, having a base provided with feeding busbars is secured to the outer side of the base and cathode members immersed in the electrolyte and secured to the inner side of the base so that a common cathode space is formed between the cathode members and the base, an electrolyte supply device, a chlorine tapping device, alkali and hydrogen tapping devices, the electrolyzer casing is made, according to the invention, as a hollow solid cylinder of a corrosion-resistant nonconducting material, its bases being secured to the bases of the monopolar electrodes forming a sealed cylindrical chamber.

It is advisable that the electrolyzer casing be provided with an external metal shell intimately mating its outer surface.

It is also advisable that the base of each end monopolar electrode have the shape of a spherical segment, its base diameter being as close to the diameter of the cylindrical casing cross-section as possible.

It is preferable that in an electrolyzer comprising at least one bipolar electrode located between the monopolar electrodes and provided with a current distributing base, the anode members being secured on its one side and the cathode members being secured on the other side, a common cathode space being formed between the cathode members and the base, the shape of the current distributing bases of the bipolar electrodes correspond to the shape of the cylindrical casing cross-section and their size be as close as possible to the inner diameter of the cylindrical casing, an opening being made in the upper part of said current distributing bases over the anode and cathode members.

It is also preferable that in an electrolyzer a membrane be located between the anode and cathode members, the bases of the bipolar electrodes and the base of the anode be provided with at least one hole of a minimum free section, besides at least one cathode member of the cathode and at least one cathode member of each bipolar electrode be made partially opened from their ends and connected through an insulation gasket to the bases of adjacent electrodes in places of location of the openings in the bases forming a common collector to collect and tap the electrolysis products produced on the cathode members.

It is possible that in an electrolyzer comprising a membrane located between the anode and cathode members of the electrodes, the bases of the bipolar electrodes and the base of the cathode be provided with at least one hole of a minimum free section, besides at least one cathode member of the cathode and at least one cathode member of each bipolar electrode, except the bipolar electrode located near the anode, be made partially opened from their ends and communicate through an insulating gasket with the bases of adjacent electrodes in places of location of the openings in the bases forming a common collector for collection and tapping of the electrolysis products produced on the cathode members of the electrodes.

It is also possible that the bases of the bipolar electrodes and the base of one monopolar electrode be provided with holes of a minimum free section located over the electrode members within the limits of the common cathode space, tubular members coaxial with the openings in the electrode bases being positioned along the perimeter of said openings between the electrode bases, said tubular members are tightly connected to one another and form a common collector for output of the electolysis products produced on the cathode members.

It is preferable that each tubular member comprise a connecting pipe attached to the electrode base from the side of the cathode members, extending through the common cathode space and provided with a plurality of holes along the perimeter in order to communicate the connecting pipe space with the common cathode space, a flange attached to the base from the side of the anode members and a branch pipe made of a nonconducting material tightly fitted between the connecting pipe of one electrode and the flange of the adjacent electrode.

It is also preferable that the electrolyzer casing be provided with openings for outlet of the electrolysis cathode products from the bipolar electrodes having tightly fitted branch pipes secured to the base of the bipolar electrodes and communicating with the common space of the cathode members.

This invention permits production of chlorine under excess pressure. The diameter of the pipelines carrying chlorine can be made smaller and, besides, it is possible to do without gas blowers and compressors required for transportation of chlorine gas and chlorine obtained at normal pressure.

The invention will now be described in greater detail with reference to a specific embodiment thereof, taken in conjunction with the accompanying drawings, wherein.

Figure 5:
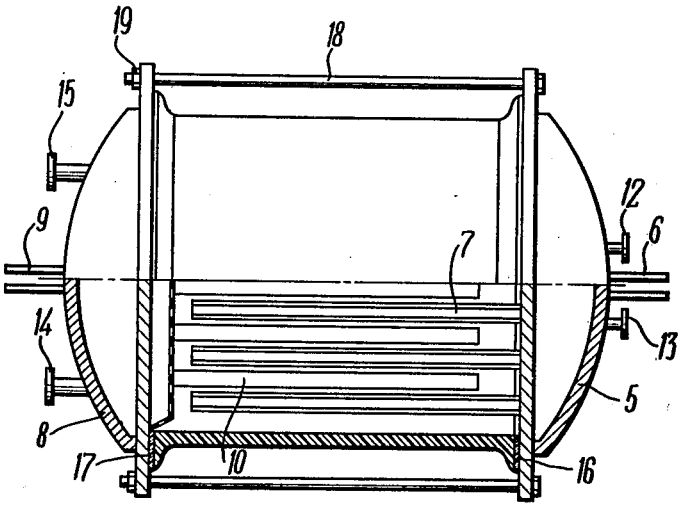
Figure 4:
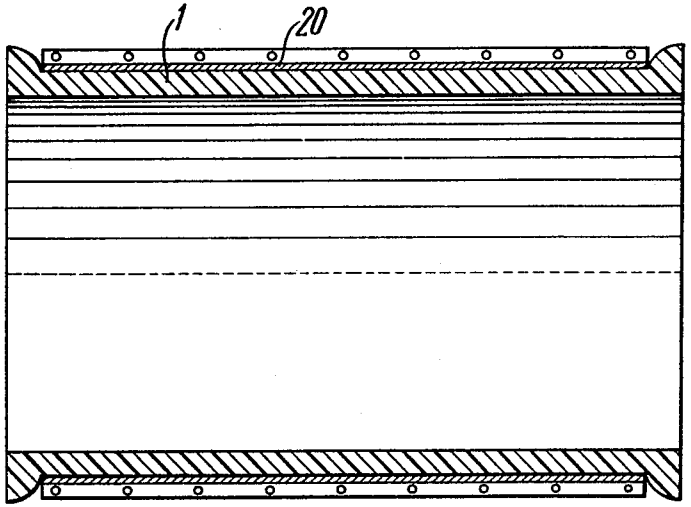
FIG. 4 is a lateral section view of an electrolyzer casing, according to the invention.
Figure 4A:
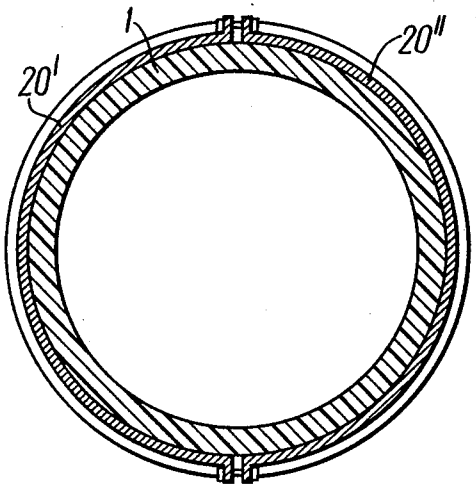
Figure 6:
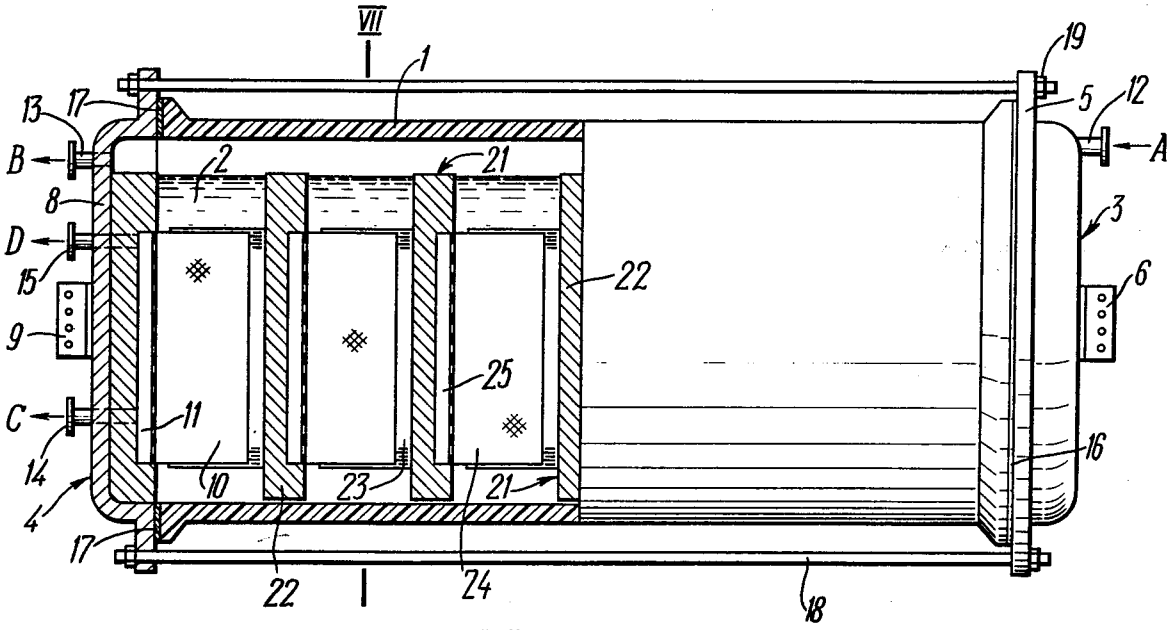
Figure 7:
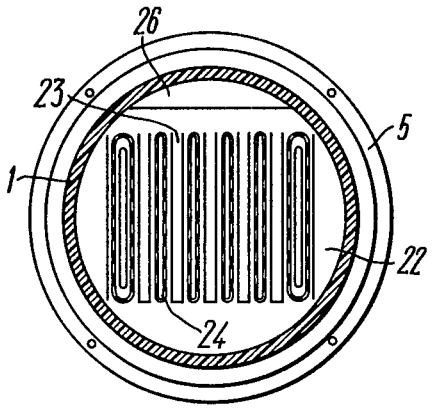
Figure 8:
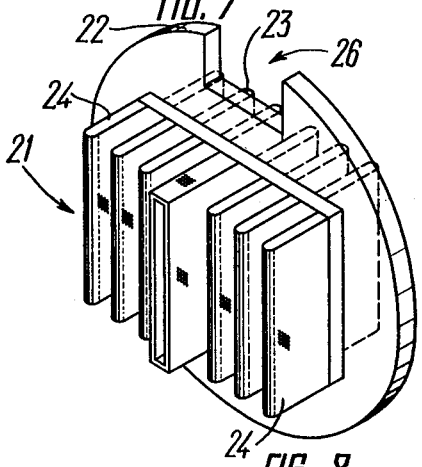
Figure 9:
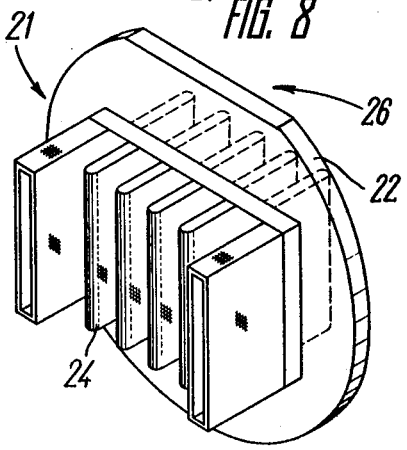
Figure 10:
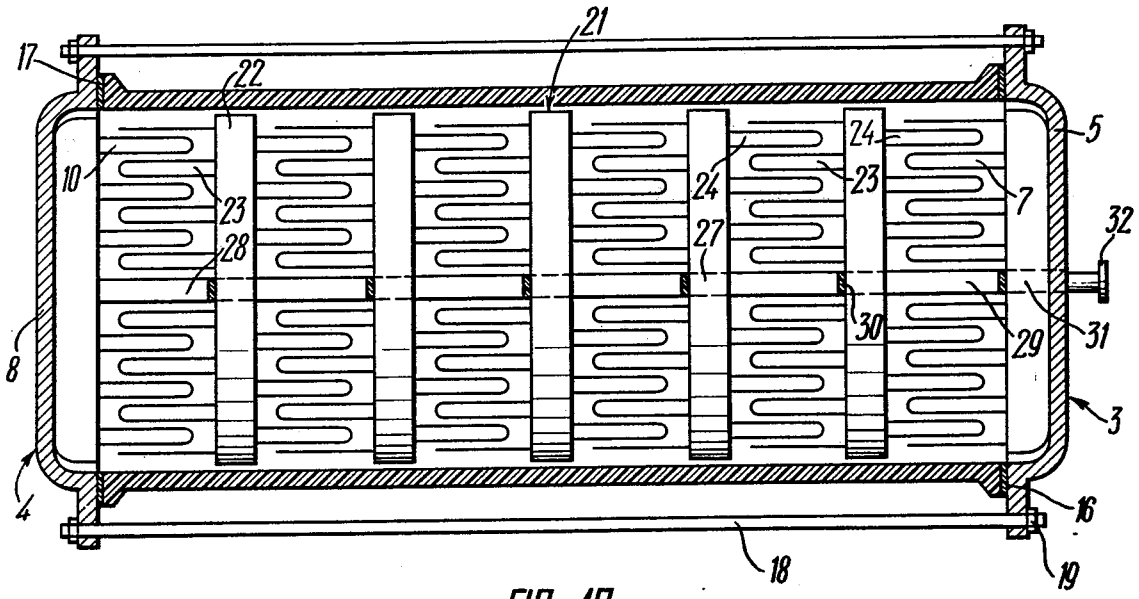
Figure 11:
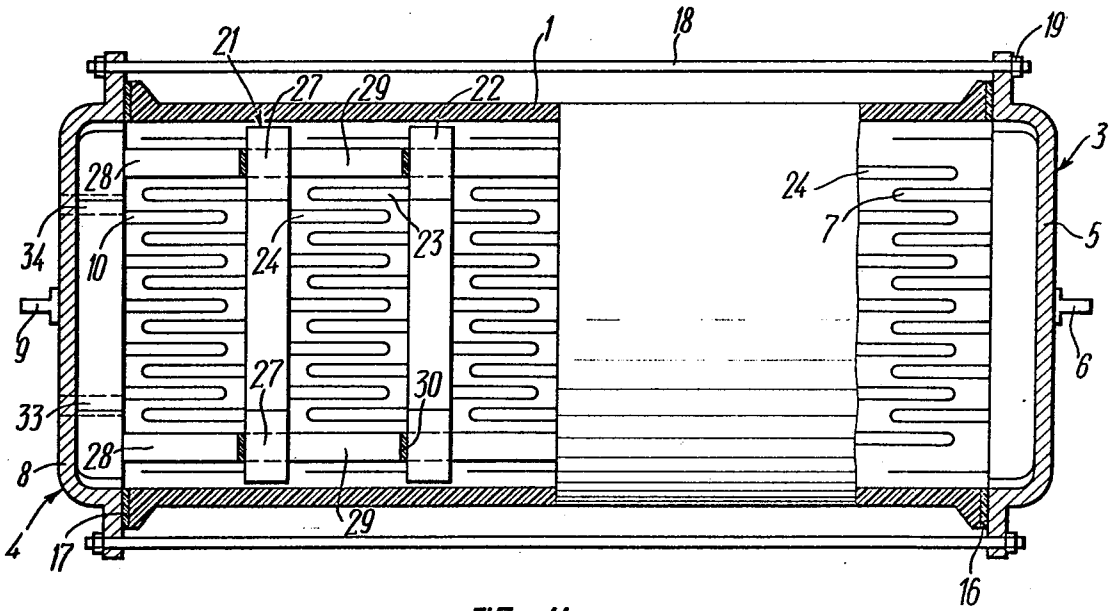
Figure 13:
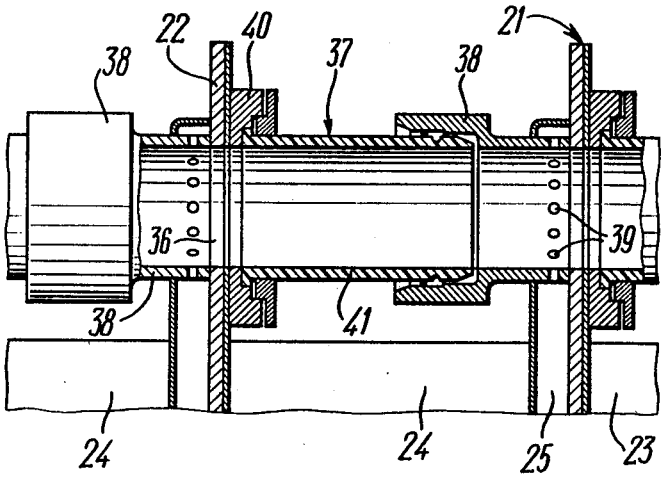
Figure 12:
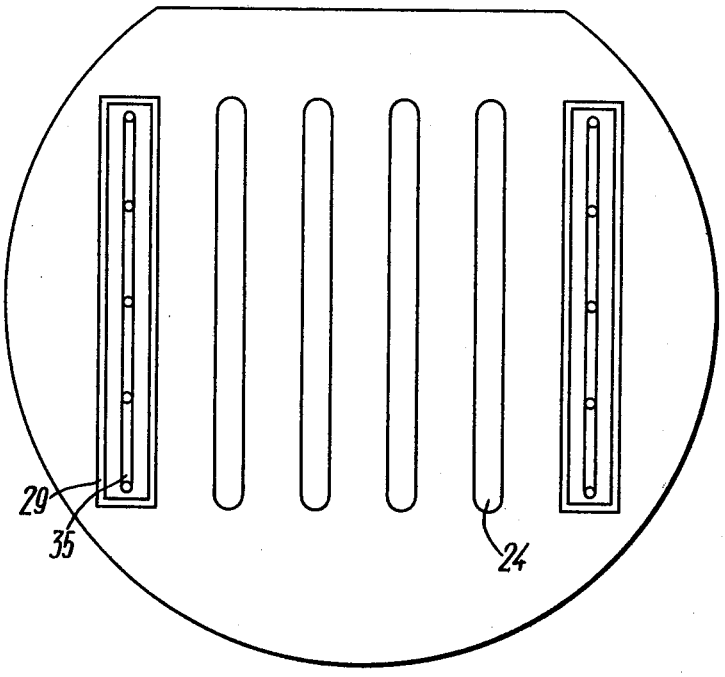
Figure 14:
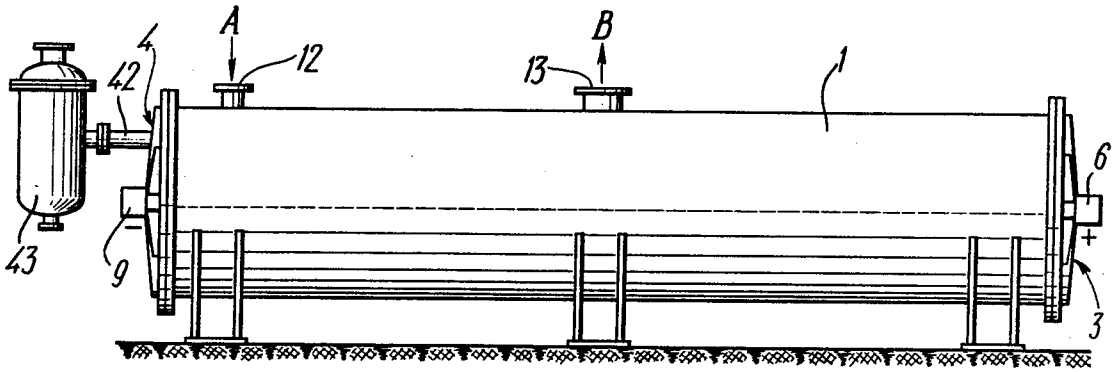
Figure 15:
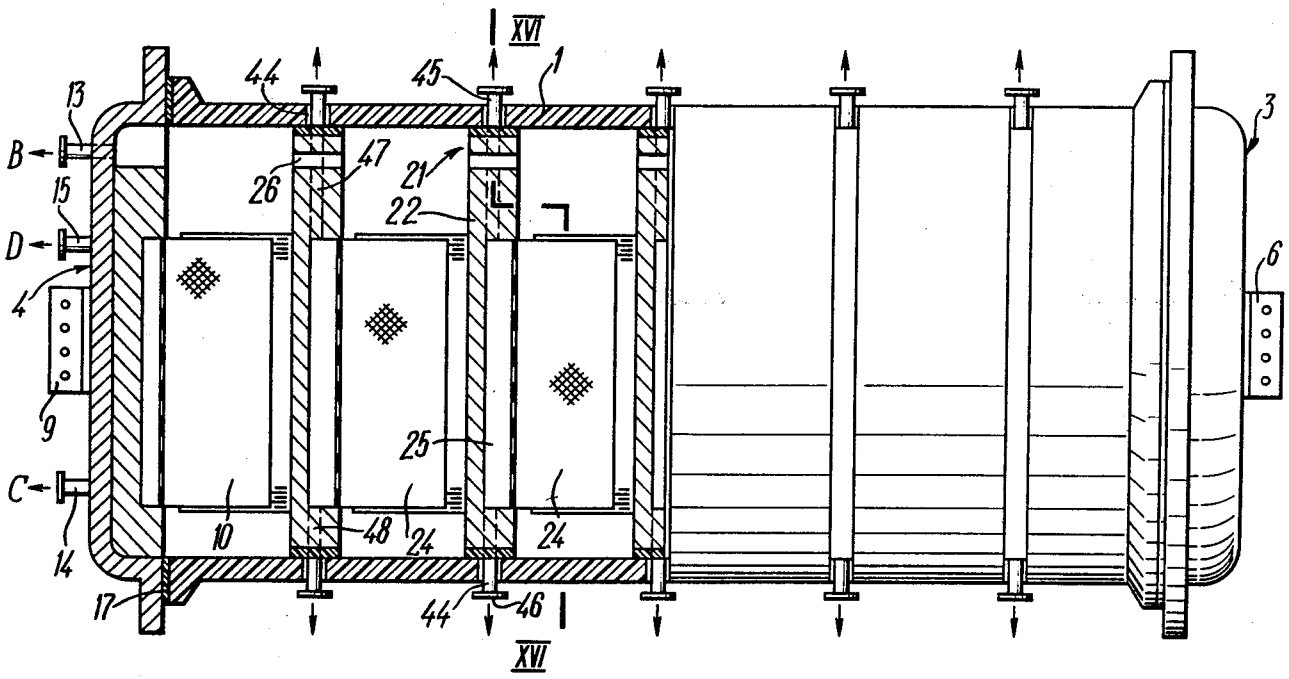
Figure 16:
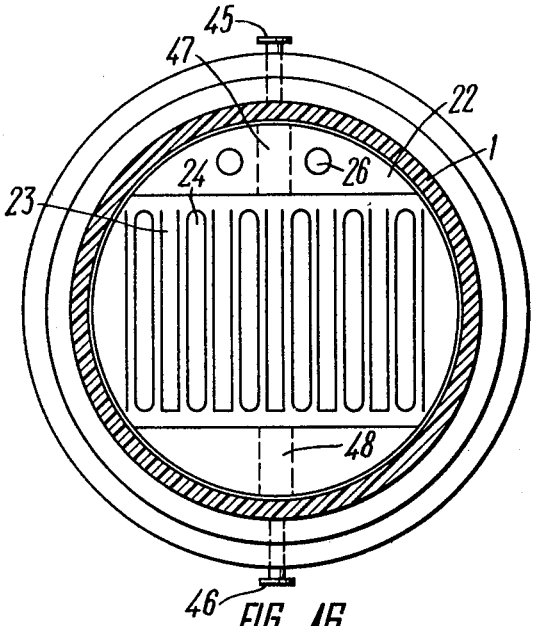
Figure 17:
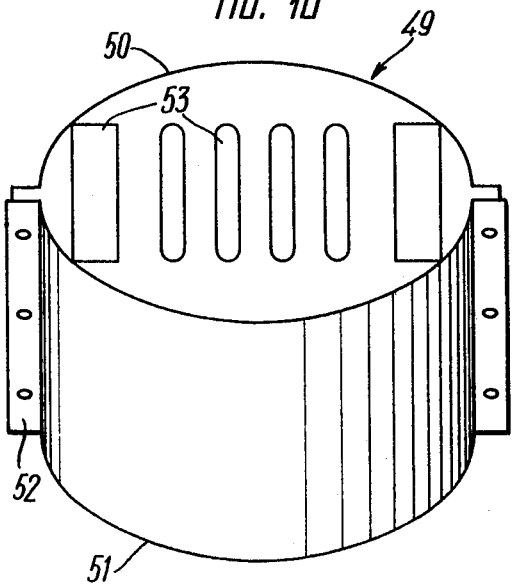

FIG. 4*a* is a cross section view of an electrolyzer casing of FIG. 4, according to the invention;

FIG. 5 is a top view of an electrolyzer featuring a spherical lid, according to the invention;

FIG. 6 is a lateral view of an electrolyzer featuring bipolar electrodes, according to the invention;

FIG. 7 is a section view taken along line VII—VII of FIG. 6 according to the invention;

FIG. 8 is an isometric view of an embodiment of a bipolar electrode, according to the invention;

FIG. 9 is an isometric view of another embodiment of a bipolar electrode, according to the invention;

FIG. 10 is a top view of an embodiment of an electrolyzer featuring bipolar electrodes, according to the invention;

FIG. 11 is a top view of another embodiment of an electrolyzer featuring bipolar electodes, according to the invention;

FIG. 12 is a view from the side of cathode members of a bipolar electrode of FIG. 9, according to the invention;

FIG. 13 is an embodiment of a collector for collection of the electrolysis products produced on the cathode members, according to the invention;

FIG. 14 is a general view of an electrolyzer featuring the collector of FIG. 13, according to the invention;

FIG. 15 is one more embodiment of an electrolyzer featuring bipolar electrodes, according to the invention;

FIG. 16 is a section view taken along line XVI—XVI of FIG. 15, according to the invention;

FIG. 17 is a device for the electrolyzer assembly, according to the invention;

An electrolyzer for electrolysis of aqueous solutions of chlorites of alkali metals comprises a horizontally placed casing 1 (FIG. 1) filled with an electrolyte 2 which is an aqueous solution of sodium chloride and two end monopolar electrodes: an anode 3 and a cathode 4.

The anode 3 is provided with a base 5 with feeding busbars 6 connected to the outer side of the base and anode members 7 secured on the inner side of the base 5 and immersed into the electrolyte 2.

The base 5 is made of a titanium or steel sheet with a protective coating against the action of the electrolysis products.

The anode members 7 are made of a titanium grid of a perforated titanium sheet coated by an anode-active film, e.g. ruthenium dioxide.

The cathode 4 is provided with a base 8 with feeding busbars 9 connected to the outer surface of the base 8. Cathode members 10 are secured on the inside surface of the base 8 so that a common cathode space 11 is formed between the cathode members 10 and the base 8.

The base 8 is made of a steel sheet, whereas the cathode members 10 are made of a steel grid.

The electrolyzer also comprises an electrolyte supplying device 12 which is a connecting pipe placed on the casing 1, a chlorine tapping device 13 which is a connecting pipe located on the base 5 of the anode 3 over the level of the electrolyte 2, an alkali tapping device 14 and a hydrogen tapping device 15 which are also connecting pipes located on the base 8 of the cathode 4. Arrows A, B, C, D indicate directions for supply of electrolyte and tapping of chlorine, alkali and hydrogen, respectively.

The electrolyzer casing 1 is a cylinder of a corrosion-resistant nonconductive material, e.g. fiberglass plastic, the bases of said cylinder being attached to the bases 5 and 8 of the anode 3 and the cathode 4 forming a tight cylindrical chamber. In order to ensure pressurization, sealing gaskets 16 and 17 are placed between the casing 1 and the bases 5 and 8, respectively.

The casing 1, the anode 3 and the cathode 4 are tightened by means of anchor bolts 18 and nuts 19.

Figure 1:
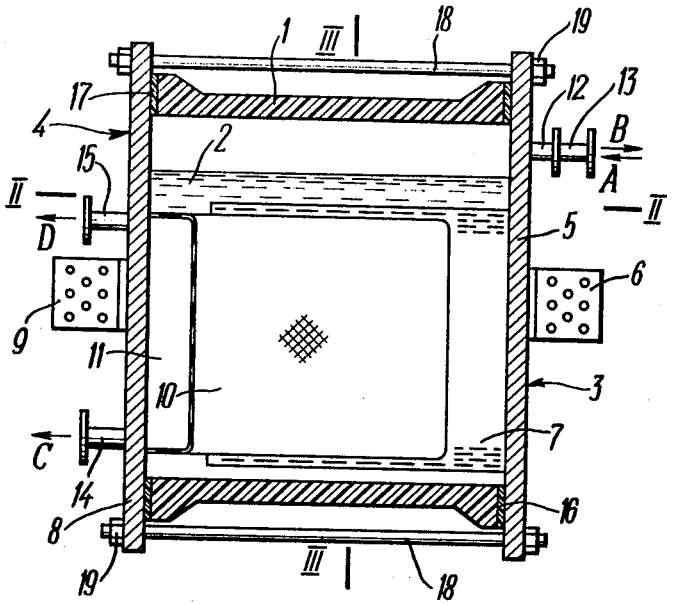
FIG. 1 is a lateral section view of an electrolyzer, according to the invention.
Figure 2:
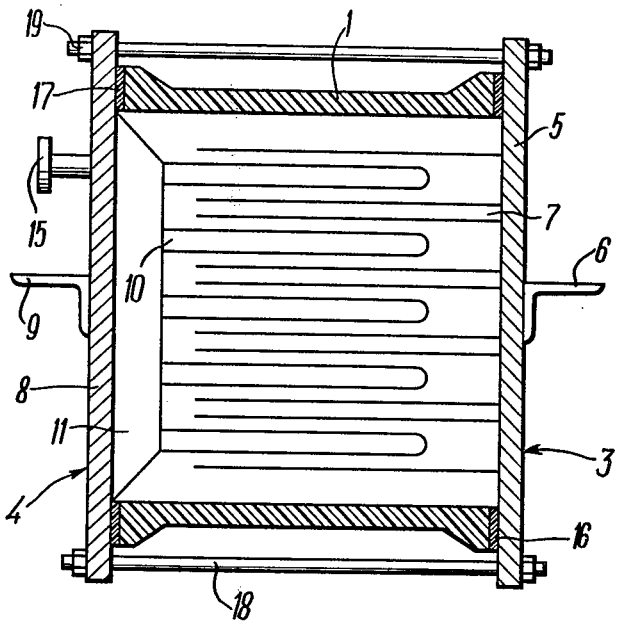
FIG. 2 is a section view taken along line II—II of FIG. 1, according to the invention.

FIG. 2 shows a section view of the electrolyzer taken along line II—II of FIG. 1.

Figure 3:
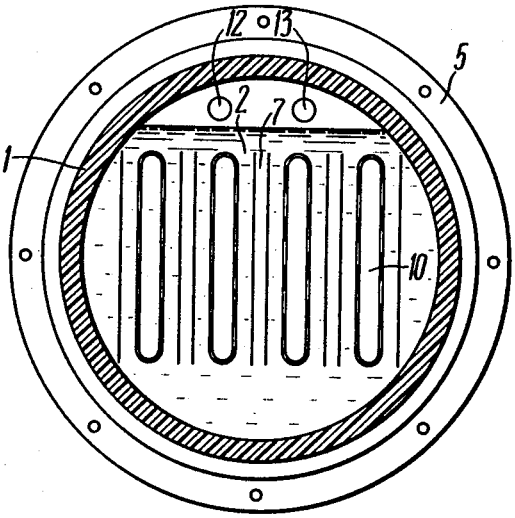
FIG. 3 is a section view taken along line III—III of FIG. 1, according to the invention.

FIG. 3 shows a section view of the electrolyzer taken along line III—III of FIG. 1.

The electrolyzer casing 1 is provided on the outside with a metal shell 20 (FIG. 4) closely mating the outer surface of the casing 1.

The shell 20 is made up of two cylinder halves $20^{I}$ and $20^{II}$ (FIG. 4*a*) secured together.

Referring to FIG. 5, embodiments of bases 5 and 8 of the anode 3 and the cathode 4 are made as spherical segments, the diameter of their bases is equal to the cross-sectional diameter of the cylindrical casing 1.

Referring to FIG. 6, an electrolyzer comprises bipolar electrodes 21 located between the anode 3 and the cathode 4.

Each bipolar electrode 21 has a current distributing base 22, anode members 23 being secured on one side and cathode members 24 being secured on the other side.

The anode members 23 of the bipolar electrode 21 are similar to the anode members 7 of the anode 3, (FIGS. 1-3) whereas the cathode members 24 are similar to the cathode members 10 of the cathode 4 (FIGS. 1-3).

A common cathode space 25 is formed between the cathode members 24 and the base 22.

FIG. 7 shows a section view taken along line VII--VII of FIG. 6.

The shape of the current distributing bases 22 of the bipolar electrodes 21 corresponds to the shape of the cross-section of the cylindrical casing 1, whereas their size is equal to the inner diameter of the cylindrical casing 1, an opening 26 is made in the upper part of these current distributing bases 22 above the anode members 23 and the cathode members 24.

FIG. 8 shows an isometric view of a bipolar electrode, in accordance with the invention.

The opening 26 in the base 22 is made as a rectangular cut in the base 22 in its upper part above the anode members 23 and the cathode members 24.

FIG. 9 shows an isometric view of an embodiment of the bipolar electrode 21. In this embodiment the opening is made by cutting a segment in the upper part of the base 22 of the bipolar electrode 21.

Holes 27 are made in the bases 22 of the bipolar electrodes 21 (FIG. 10).

Cathode members 28 of the cathode 4 and cathode members 29 of the bipolar electrodes 21 are provided with a narrow slot in the ends and are connected through an insulation gasket 30 with the bases of adjacent electrodes, namely, the cathode members 28 to the base 22 of the adjacent bipolar electrode 21, the cathode members 29 to the bases 22 of the adjacent bipolar electrodes 21, whereas the cathode members 29 of the bipolar electrode located near the anode 3 are connected to the base 5 of the anode 3.

The electrolyzer comprises a membrane (not shown) located between the anode members 7 and the cathode members 24, between the anode members 23 and the cathode members 24, and between the anode members 23 and the cathode members 10.

The length of the cathode members 28 and 29 and the thickness of the insulation gasket 30 determine the distance between the base 8 of the cathode 4 and the base 22 of the bipolar electrode 21, whereas the length of the cathode members 29 and the thickness of the insulating gasket 30 determine the distance between the bases 22 of the adjacent bipolar electrodes 21 and the distance between the base 22 and the base 5 of the anode 3.

The cathode members 28 and 29 are connected through the insulating gaskets 30 to the bases 22 and 5 of the adjacent electrodes in places of location of the holes 27 in the bases 22 forming a common collector for collection of the electrolysis products produced on the cathode members 10, 24, 28, 29.

Discharge of the electrolysis products collected in the collector is performed through an opening 31 made in the base 5 of the anode 3 and a connecting pipe 32 attached to the base 5 at the place of location of the opening 31.

In another embodiment of an electrolyzer the two cathode members 28 (FIG. 11) of the cathode 4 and the two cathode members 29 of each bipolar electrode 21, except the bipolar electrode 21 located near the anode 3, are provided with a narrow slot in the butts and are connected through an insulating gasket 30 to the bases of the adjacent electrodes in places of location of the openings 27 in the bases 22 of the bipolar electrodes 21 forming a common collector for collection of the electrolysis products obtained on the cathode members 10, 24, 28 and 29 of the electrodes.

The products of the electrolysis are discharged from the collector through openings 33 and 34 made in the base 8 of the cathode 4.

FIG. 12 shows a lateral view of a bipolar electrode of FIG. 9.

The cathode members 19 are provided with a rigid framework 35 made as a metal frame located inside the cathode member 29.

In another embodiment of an electrolyzer the bases 22 (FIG. 13) of the bipolar electrodes 21 are provided with holes 36 located over the electrode members 23, 24 within the limits of the common cathode space 25.

Tubular members 37 are placed along the perimeter of the holes 36 between the bases 22 of the electrodes 21 and coaxially with the holes 36. The tubular members 37 are tightly connected to one another and form a common collector for output of the electrolysis products obtained on the cathode members.

Each tubular member 37 includes a connecting pipe 38 attached to the base 22 of the electrode 21 from the side of the cathode members 24, extending the common cathode space and provided with a plurality of holes 39 along the perimeter in order to communicate the space of the connecting pipe 38 with the common cathode space 25.

Each tubular members 37 also includes a flange 40 attached to the base 22 from the side of the anode members 23 and a branch pipe 41 made of a nonconducting material and tightly fitted between the connecting pipe 38 of one electrode 21 and the flange 40 of the adjacent electrode 21.

The tubular members 37 is similarly fitted between the cathode 4 and the adjacent bipolar electrode 21.

The collected electrolysis products are tapped through a connecting pipe 42 (FIG. 14) connected to a separator 43.

FIG. 15 shows an embodiment of an electrolyzer, wherein the casing 1 is provided with holes 44 for output of the cathode electrolysis products produced on the cathode members 24 of the bipolar electrodes 21.

Branch pipes 45 and 46 are fitted into the holes 44 and connected to the base 22 of the bipolar electrodes 21. Said branch pipes 45 and 46 communicate with the common space 25 of the cathode members 24 through holes 47 and 48.

FIG. 16 shows a section view taken along line XVI—XVI of FIG. 15.

In this embodiment of an electrolyzer the opening 26 is formed by two holes made in the base 22 and located over the level of the electrolyte 2.

FIG. 17 shows a device 49 for assembly of the electrolyzer.

The device 49 is made as two half-cylinders 50 and 51 provided with protrusions 52.

For assembly of the electrolyzer the half-cylinders 50 and 51 are secured together and form a cylinder.

One of the ends of the cylinder has slots 53 which correspond to the shape and size of the cathode members. The other end of the cylinder is provided with slots (not shown) which correspond to the shape and size of the anode members.

The electrolyzer is assembled as follows.

The monopolar electrode-cathode 4 (FIG. 1) is mounted on the assembly plate (not shown) so that its base 8 lies on said plate and the cathode members 10 are directed vertically upwards. The gasket 17 is put on the base 8. Then the electrolyzer casing 1 is mounted on the gasket 17 and its position with respect to the cathode members 10 is determined by fixing elements (not shown). A sealing gasket 16 is put on the upper end of the casing 1 and another monopolar electrode-anode 3 is mounted thereupon.

The position of the anode 3 with respect to the casing 1 is also determined by fixing elements (not shown). The cathode members 10 of the cathode 4 are equally spaced between the anode members 7 of the anode 3.

The anode 3, the cathode 4 and the casing 1 placed therebetween are tightened by means of the anchor bolts 18 and the nuts 19 and, as a result, a pressurized cylindrical chamber is formed. A hoisting gear is used to move the electrolyzer to its working place where it is positioned so that its casing 1 is located horizontally. Then all pipes and electrical connections are joined and the electrolyzer is filled with the electrolyte.

The electrolyzer provided with bipolar electrodes is assembled as follows.

The monopolar electrode-cathode 4 (FIG. 11) is placed on a horizontal assembly plate so that its base lies on this plate and the cathode members 10 and 28 are directed vertically upwards.

A device 49 (FIG. 17) is also mounted on this plate so that it fits the base along its perimeter.

At first, the half-cylinder 50 is mounted, then comes the half-cylinder 51 so that the cathode members 10 and 28 fit in the slots 53 made in one end of the cylinder. Then the half-cylinders 50 and 51 are secured together by bolts extending in the holes in the protrusions 52.

The bipolar electrode 21 (FIG. 11) is then mounted on the device 49 so that the anode members 23 extend through the slots made in the other end of the cylinder. Then, a second device 49 (FIG. 17) is put on the bipolar electrode 21 so that the cathode members 24 and 29 (FIG. 11) of the bipolar electrode 21 fit into the slots 51.

The next bipolar electrode 21 is mounted in a similar manner, that is its anode members 23 fit into the slots located on the other end of the cylinder of the second device 49 (FIG. 17). In this manner all bipolar electrodes 21 (FIG. 11) are installed. The gaskets 30 are placed on the open ends of the cathode members 28 and 29 during electrode installation and these cathode members 28 and 29 are matched with the openings 27 made in the bases 22 of the bipolar electrodes 21.

The devices 49 (FIG. 17) are removed, when all bipolar electrodes 21 are mounted.

The sealing gasket 17 is placed on the base 8 of the cathode 4 and the casing is mounted thereupon. Its position with respect to the cathode members 10 is determined by the fixing elements (not shown).

The sealing gasket 16 is placed on the upper end of the casing 1 and the monopolar electrode-anode 3 is mounted thereupon. The position of the anode 3 with respect to the casing 1 is also determined by the fixing elements (not shown). The cathode members 10 of the cathode 4 are spaced equally between the anode members 23 of the bipolar electrodes 21, whereas the cathode members 24 of the bipolar electrodes 21 are spaced equally between the anode members 23 of the bipolar electrodes 21 and between the anode members 7 of the anode 3.

The anode 3, the cathode 4, the bipolar electrodes 21 and the casing 1 are tightened by the anchor bolts 18 with the nuts 19 and, as a result, a pressurized cylindrical chamber is formed. The electrolyzer is transported by a hoist gear to its working place and mounted so that the casing 1 is placed horizontally.

Then all pipe and electrical connections are joined and the electrolyzer is filled with the electrolyte.

Other embodiments of the electrolyzer are assembled in a similar manner and the device 49 is made so that the slots on its ends correspond to the shape and size of the anode and cathode members of the electrodes employed in a given electrolyzer.

The electrolyzer of FIG. 1 operates as follows.

The electrolyzer is filled with the electrolyte 2 (aqueous solution of sodium chloride) through the pipe 12 and the cathode 4 and the anode 3 are energized.

When electrical current passes through the electrolyte 2, chlorine is isolated on the anode members 7, whereas alkali and hydrogen are produced on the cathode members 10 (or chlorates, if there is no membrane).

The released chlorine is collected in the upper part of the casing 1 over the electrolyte 2 and is discharged through the connecting pipe 13. The isolated alkali and hydrogen collect in the common cathode space 11 and are discharged through the connecting pipes 14 and 15, respectively. Shut-off valves (not shown) are fitted on the outlet pipes for discharge of the electrolysis products and inlet of the electrolyte in order to build up the pressure in the electrolyzer to 10–12 atm.

When electrolysis is performed with a membrane, the electrolyzer is equipped with a device for maintaining equal pressure of chlorine and hydrogen. Known devices employed for pressure electrolysis of water can be used for this purpose.

This invention permits production of chlorine under elevated pressure.

The diameter of pipelines used for transportation of chlorine can be made smaller, and besides it becomes possible to do without gas blowers and compressors required for liquefying chlorine produced at normal pressure.

What is claimed is:

1. An electrolytic cell, suitable for electrolysis at elevated pressures, comprising:

(a) a uniform horizontally disposed cylindrical cell casing made from a corrosion-resistant non-conducting material having opposite and substantially parallel ends having a first opening at one end of said cell casing and a second opening at the opposite end of said cell casing;

(b) an electroconductive monopolar electrode-cathode plate sealingly attached to said cell casing to withstand leakage at elevated pressure and covering said first opening, said cathode plate having a plurality of cathode members attached to the inner surface of said cathode plate, and a base for said cathode with feeding busbars connected to the outer side of said cathode base, said cathode members being secured to the inner side of said base so that a common cathode space is formed between said cathode base and said cathode members;

(c) an electroconductive monopolar electrode-anode plate sealingly attached to said cell casing to withstand leakage at elevated pressure and covering said second opening, said anode plate having a plurality of anode members attached to the inner surface of said anode plate, and a base for said anode with feeding busbars connected to the outer side of said anode base;

(d) at least one bipolar electrode positioned between said monopolar electrodes, internally attached within said cylindrical cell casing and whose current distributing base has a shape corresponding to the cross-section of said cylindrical cell casing and its diameter being slightly less than the inner diameter of said cylindrical cell casing with anode members secured on one side of the current distributing base of said bipolar electrode and cathode members secured on the opposite side of said current distributing base of said bipolar electrode so that a common space is formed between said cathode members and said bipolar electrode base;

(e) said current distributing base of said bipolar electrode containing an opening above the common cathode space;

(f) a membrane positioned between said anode and cathode members of said electrodes;

(g) an electrolyte supplying device;

(h) a chlorine tapping device; and (i) an alkali and hydrogen tapping device.

2. The electrolytic cell of claim 1, wherein the base of each monopolar electrode has the shape of a spherical segment, its base diameter being equal to the diameter of the cross section of said cylindrical cell casing.

3. The electrolytic cell of claim 1, wherein said casing is provided with an external metal shell intimately mating its outer surface.

4. The electrolytic cell of claim 3, wherein the base of each monopolar electrode has the shape of a spherical segment, its base diameter being substantially equal to the diameter of the cross section of said cylindrical cell casing.

5. The electrolytic cell of claim 1, wherein said casing contains a plurality of openings for removing the cathode products of electrolysis from the bipolar electrode, and wherein the openings contain tightly fitted branch pipes attached to the bipolar electrodes which communicate with the common cathode space.

6. An electrolytic cell, suitable for electrolysis at elevated pressures, comprising:

(a) a uniform horizontally disposed cylindrical cell casing made from a corrosion-resistant non-conducting material having opposite and substantially parallel ends having a first opening at one end of said cell casing and a second opening at the opposite end of said cell casing;

(b) an electroconductive monopolar electrode-cathode plate sealingly attached to said cell casing to withstand leakage at elevated pressure, and covering said first opening, said cathode plate having a plurality of cathode members attached to the inner surface of said cathode plate, and a base for said cathode with feeding busbars connected to the outer side of said cathode base, said cathode members being secured to the inner side of said base so that a common cathode space is formed between said cathode base and said cathode members;

(c) an electroconductive monopolar electrode-anode plate sealingly attached to said cell casing to withstand leakage at elevated pressure, and covering said second opening, said anode plate having a plurality of anode members attached to the inner surface of said anode plate, and a base for said anode with feeding busbars connected to the outer side of said anode base;

(d) at least one bipolar electrode positioned between said monopolar electrodes, internally attached within said cylindrical cell casing and whose current distributing base has a shape corresponding to the cross section of said cylindrical cell casing and its diameter being slightly less than the inner diameter of said cylindrical cell casing with anode members secured on one side of the current distributing base of said bipolar electrode and cathode members secured on the opposite side of said current distributing base of said bipolar electrode so that a common space is formed between said cathode members and said bipolar electrode base;

(e) at least one opening made in the bases of said bipolar electrodes and the base of said monopolar electrodeanode, said openings surrounded by an insulating gasket;

(f) at lease one cathode member of the cathode and at least one cathode member of each bipolar electrode being provided with slotted holes in their ends and connected through the insulating gasket to the base openings of adjacent electrodes to form a common collector for collection and output of alkali and hydrogen;

(g) said current distributing base of said bipolar electrode containing an opening above the common cathode space;

(h) a membrane positioned between said anode and cathode members of said electrodes;

(i) an electrolyte supplying device;

(j) a chlorine tapping device; and (k) an alkali and hydrogen tapping device.

7. The electrolytic cell of claim 6, wherein the base of each monopolar electrode has the shape of a spherical segment, its base diameter being equal to the diameter of the cross section of said cylindrical cell casing.

8. The electrolytic cell of claim 6, wherein said casing is provided with an external metal shell intimately mating its outer surface.

9. The electrolytic cell of claim 8, wherein the base of each monopolar electrode has the shape of a spherical segment, its base diameter being substantially equal to the diameter of the cross section of said cylindrical cell casing.

10. An electrolytic cell, suitable for electrolysis at elevated pressures, comprising:

(a) a uniform horizontally disposed cylindrical cell casing made from a corrosion-resistant non-conducting material having opposite and substantially parallel ends having a first opening at one end of said cell casing and a second opening at the opposite end of said cell casing;

(b) an electroconductive monopolar electrode-cathode plate sealingly attached to said cell casing to withstand leakage at elevated pressure, and covering said first opening, said cathode plate having a plurality of cathode members attached to the inner surface of said cathode plate, and a base for said cathode with feeding busbars connected to the outer side of said cathode base, said cathode members being secured to the inner side of said base so that a common cathode space is formed between said cathode base and said cathode members;

(c) an electroconductive monopolar electrode-anode plate sealingly attached to said cell casing to withstand leakage at elevated pressure, and covering said second opening, said anode plate having a plurality of anode members attached to the inner surface of said anode plate, and a base for said anode with feeding busbars connected to the outer side of said anode base;

(d) at least one bipolar electrode positioned between said monopolar electrodes, internally attached within said cylindrical cell casing and whose current distributing base has a shape corresponding to the cross section of said cylindrical cell casing and its diameter being slightly less than the inner diameter of said cylindrical cell casing with anode members secured on one side of the current distributing base of said bipolar electrode and cathode members secured on the opposite side of said current distributing base of said bipolar electrode so that a common space is formed between said cathode members and said bipolar electrode base;

(e) at least one opening made in the bases of said bipolar electrodes and the base of said monopolar electrode-cathode, said openings surrounded by an insulating gasket;

(f) at least one cathode member of the cathode and at least one cathode member of each bipolar electrode, except for the bipolar electrode adjacent to said anode being provided with slotted holes in their ends and connected through the insulating gasket to the base openings of adjacent electrodes to form a common collector for collection and output of alkali and hydrogen;

(g) said current distributing base of said bipolar electrode containing an opening above the common cathode space;

(h) a membrane positioned between said anode and cathode members of said electrodes;

(i) an electrolyte supplying device; p1 (j) a chlorine tapping device; and (k) an alkali and hydrogen tapping device.

11. The electrolytic cell of claim 10, wherein said casing is provided with an external metal shell intimately mating its outer surface.

12. The electrolytic cell of claim 10, wherein the base of each monopolar electrode has the shape of a spherical segment, its base diameter being equal to the diameter of the cross section of said cylindrical cell casing.

13. The electrolytic cell of claim 11, wherein the base of each monopolar electrode has the shape of a spherical segment, its base diameter being equal to the diameter of the cross section of said cylindrical cell casing.

14. An electrolytic cell, suitable for electrolysis at elevated pressures, comprising:

(a) a uniform horizontally disposed cylindrical cell casing made from a corrosion-resistant non-conducting material having opposite and substantially parallel ends having a first opening at one end of said cell casing and a second opening at the opposite end of said cell casing;

(b) An electroconductive monopolar electrode-cathode plate sealingly attached to said cell casing to withstand leakage at elevated pressure, and covering said first opening, said cathode plate having a plurality of cathode members attached to the inner surface of said cathode plate, and a base for said cathode with feeding busbars connected to the outer side of said cathode base, said cathode members being secured to the inner side of said base so that a common cathode space is formed between said cathode base and said cathode members;

(c) an electroconductive monopolar electrode-anode plate sealingly attached to said cell casing to withstand leakage at elevated pressure, and covering said second opening, said anode plate having a plurality of anode members attached to the inner surface of said anode plate, and a base for said anode with feeding busbars connected to the outer side of said anode base;

(d) at least one bipolar electrode positioned between said monopolar electrodes, internally attached within said cylindrical cell casing and whose current distributing base has a shape corresponding to the cross section of said cylindrical cell casing and its diameter being slightly less than the inner diameter of said cylindrical cell casing with anode members secured on one side of the current distributing base of said bipolar electrode and cathode members secured on the opposite side of said current distributing base of said bipolar electrode so that a common space is formed between said cathode members and said bipolar electrode base;

(e) at least one opening made in the bases of at least one said bipolar electrodes and the base of said monopolar electrodes located above the electrode members within the common cathode space;

(f) tubular members located along the perimeter of said openings between the bases of said electrodes, arranged coaxially with the openings in the electrode bases and connected to one another to form a common collector for output of alkali and hydrogen;

(g) said current distributing base of said bipolar electrode containing an opening above the common cathode space;

(h) a membrane positioned between said anode and cathode members of said electrodes;

(i) an electrolyte supplying device;

(j) a chlorine tapping device; and (k) an alkali and hydrogen tapping device.

15. The electrolytic cell of claim 14, wherein each said tubular member includes a connecting pipe attached to the electrode base from the side of cathode members, extending through the common cathode space and provided with a plurality of openings along its perimeter to communicate the space of said connecting pipe with said common cathode space with a flange attached to said base from the side of said anode members, and a branch pipe made of non-conducting material and tightly fitted between the connecting pipe of each electrode and the flange of said adjacent electrode.

16. The electrolytic cell of claim 14, wherein said casing of said electrolyzer is provided with an external metal shell intimately mating its outer surface.

17. The electrolytic cell of claim 14, wherein the base of each monopolar electrode has the shape of a spherical segment, with its base diameter equal to the diameter of the cross section of said cylindrical cell casing.

18. The electrolytic cell of claim 17, wherein said casing is provided with an external metal shell intimately mating its outer surface.

* * * * *